United States Patent [19]

Sutter

[11] 4,408,424

[45] Oct. 11, 1983

[54] TELESCOPING CYLINDER STABILIZER

[75] Inventor: Gerald Sutter, El Dorado, Kans.

[73] Assignee: Richard K. Teichgraeber, El Dorado, Kans.

[21] Appl. No.: 245,814

[22] Filed: Mar. 20, 1981

[51] Int. Cl.[3] ..... E04H 12/34; B66C 23/06

[52] U.S. Cl. ..... 52/115; 52/117; 308/3.9

[58] Field of Search ..... 52/115, 111, 117, 118; 308/3.9

[56] References Cited

U.S. PATENT DOCUMENTS

| | | | |
|---|---|---|---|
| 773,478 | 10/1904 | Conner et al. . | |
| 827,282 | 7/1906 | Anderson . | |
| 1,244,784 | 10/1917 | Shilder . | |
| 1,576,644 | 3/1926 | Drake . | |
| 1,601,254 | 9/1926 | McEwen . | |
| 1,751,348 | 3/1930 | Mitchell . | |
| 2,108,035 | 2/1938 | Fuehrer et al. . | |
| 2,128,712 | 8/1938 | Neff . | |
| 2,184,051 | 12/1939 | Moise . | |
| 2,308,203 | 1/1943 | O'Farrell . | |
| 2,365,686 | 12/1944 | Osgood . | |
| 2,576,389 | 11/1951 | Craighead et al. . | |
| 2,645,213 | 7/1953 | Huber . | |
| 2,657,017 | 10/1953 | Curtis | 308/3.9 |
| 2,689,035 | 9/1954 | Dersch . | |
| 3,016,992 | 1/1962 | Wilson | 52/115 |
| 3,346,281 | 10/1967 | Thompson | 52/115 |
| 3,413,766 | 12/1968 | Wilson et al. | 52/115 |
| 3,413,767 | 12/1968 | Wilson | 52/115 |
| 3,431,825 | 3/1969 | Crawley et al. . | |
| 3,464,169 | 9/1969 | Potain . | |
| 3,722,154 | 3/1973 | Sakamoto et al. | 52/115 |

*Primary Examiner*—John E. Murtagh
*Assistant Examiner*—Richard E. Chilcot, Jr.
*Attorney, Agent, or Firm*—Jones, Tullar & Cooper

[57] ABSTRACT

A stabilizer for a telescoping cylinder and rod is disclosed. The stabilizer includes a support body which carries a cylinder rod encircling clamp and a bell crank. The support body and bell crank are moved along a support track by operation of the cylinder. As the cylinder structure reaches its full extension, the stabilizer is deployed to clamp and stabilize the cylinder rod and cylinder assembly at a joint generally equidistant the ends of the cylinder and rod assembly. The stabilizer is actuated automatically by the extension of the cylinder and is returned to its initial position as the cylinder is retracted. The telescoping cylinder stabilizer provides support for the elongated cylinder and protects the cylinder and rod from damage due to flexure and bending which might occur were it not for the stabilizer.

20 Claims, 10 Drawing Figures

TELESCOPING CYLINDER STABILIZER

FIELD OF THE INVENTION

The present invention is directed to a telescoping cylinder stabilizer. More particularly, the present invention is directed to a telescoping cylinder stabilizer which stabilizes the cylinder rod. Most specifically, the present invention is directed to a telescoping cylinder stabilizer which deploys with extension of the cylinder and operates automatically. A support body is slidably carried on a support track and carries a cylinder rod encircling clamp or ring. The support body also carries a spring biased bell crank and roller assembly. As the cylinder is operated, a first actuating arm which is carried by the cylinder engages the bell crank to move the support body along the support track. Upon complete extension of the cylinder and rod, the stabilizer is automatically properly positioned and the cylinder rod encircling clamp is held in place about the piston rod adjacent the rod's juncture with the cylinder. The stabilizer prevents flexure and bending of the cylinder and rod so that damage to the cylinder is alleviated. Upon contraction of the cylinder and rod, the stabilizer is automatically returned to its original position by a second actuating arm.

DESCRIPTION OF THE PRIOR ART

The use of elongated cylinder assemblies for use particularly with telescoping booms and masts is known in the art. In a portable oil field servicing mast, for example, it is known to provide a two piece, vertically telescoping mast which is set up at the well site with the mast being extended to its operating height by actuation of an elongated hydraulic cylinder assembly. As the cylinder rod is moved outwardly to telescope the mast, the cylinder and rod assembly loses rigidity. Once the rod is fully extended, there has, in the past, been a serious problem since the rod and cylinder have been subject to severe flexure and binding at the point where the rod exits the cylinder. This flexure has caused undue wear on the assemblies, has reduced the height to which the mast can safely be extended, and has generally been unsatisfactory.

Several prior patents have been directed to this problem and stabilizers for telescoping cylinders are set forth in the following U.S. Pat. Nos.: 3,016,992, Wilson; 3,413,766, Wilson et al.; 3,413,767, Wilson; 3,722,154, Sakamoto et al.

While the use of telescoping cylinder stabilizers, of which the above four patents are intended to be exemplary and not a complete listing, have proved beneficial, a number of problems have been created by the use of the stabilizers. Foremost of these problems have been dependability and ease of operation. The prior telescoping cylinder stabilizers have tended to be bulky, complex, complicated mechanisms having various support arms, openable and closeable rod or cylinder gripper fingers, complex hydraulic or pneumatic operating systems and the like. These stabilizers have required the attention of, and assistance by the operator to place the stabilizer at the necessary position at the proper time and to release the stabilizer before collapsing the mast or tower. Unfortunately, as the complexity of the device increases, its frequency of use decreases. The prior mast telescoping cylinder stabilizers have had numerous moving parts, have been difficult to operate, and have required positive action by the operator to set and release. Accordingly, the prior cylinder and mast stabilizers have not been reliable or easy to operate and therefore have not been used.

SUMMARY OF THE INVENTION

It is an object of the present invention to provide a telescoping cylinder stabilizer.

Another object of the present invention is to provide a cylinder stabilizer which is automatically operable.

A further object of the present invention is to provide a cylinder stabilizer that requires no additional power supply.

Yet another object of the present invention is to provide a cylinder stabilizer having a cylinder rod clamp.

Still a further object of the present invention is to provide a cylinder stabilizer that is effective, simple in construction, easily maintained and reliable.

As will be set forth in greater detail in the description of the preferred embodiment, the telescoping cylinder stabilizer in accordance with the present invention is comprised generally of a support body which is moveably secured on a support track carried by the mast that is to be telescoped by the cylinder. The support body of the stabilizer carries a cylinder rod encircling clamp or ring. A bell crank is provided with a pair of rollers and is pivotably secured to the support body. Suitable means are carried by the cylinder to slide the support body along the track as the cylinder and hence the mast are extended or collapsed. Once the cylinder and rod are at their full extension, the stabilizer is latched into place by operation of the spring biased bell crank and the rod of the cylinder is held in place by the encircling clamp to effect stabilization of the telescoping cylinder.

In contrast to the prior known devices which, as was discussed previously, are complicated, require operator control and attention, and have often not been used, the telescoping cylinder stabilizer in accordance with the present invention is simple in construction, operates automatically without operator assistance, and requires no additional outside power. As the mast is telescoped outwardly or upwardly, the stabilizer is moved along its support track by a first actuator arm secured to the cylinder. The bell crank which is spring biased to the support body, carries rollers which ease the travel of the support body. This bell crank acts as a latch once the stabilizer has reached its desired location so that the rod encircling clamp will automatically hold the rod and cylinder in place and will effectively stabilize the cylinder. In contrast to the prior art devices, this actuation of the stabilizer is accomplished automatically as the cylinder extends. When the cylinder is retracted, the bell crank is moved to its released position by operation of a second actuator arm carried by the cylinder. Thus the stabilizer can be set and released without operator assistance. Although the stabilizer in accordance with the present invention is visible to the operator so that he can verify that it is operating, no action is required of the operator.

The cylinder stabilizer utilizes spring biasing to operate the bell crank which secures the stabilizer in place. The spring pressure is readily adjustable to control the force applied to latch or unlatch the stabilizer. In contrast with the prior devices, this cylinder stabilizer does not require an outside source of power such as compressed air or hydraulic fluid under pressure. Thus operation and maintenance are not expensive. The stabilizer has a minimum number of moving parts and is not complex in operation or structure. It is well suited for long use with little maintenance and performs the function of stabilizing elongated cylinder and rod assemblies in an expeditious, reliable manner with a greater degree of reliability than prior devices.

BRIEF DESCRIPTION OF THE DRAWINGS

While the novel features of the telescoping cylinder stabilizer in accordance with the present invention are set forth with particularity in the appended claims, a full and complete understanding of the invention may be had by referring to the description of a preferred embodiment as set forth hereinafter and as may be seen in the accompanying drawings in which:

DESCRIPTION OF A PREFERRED EMBODIMENT

Figure 1:
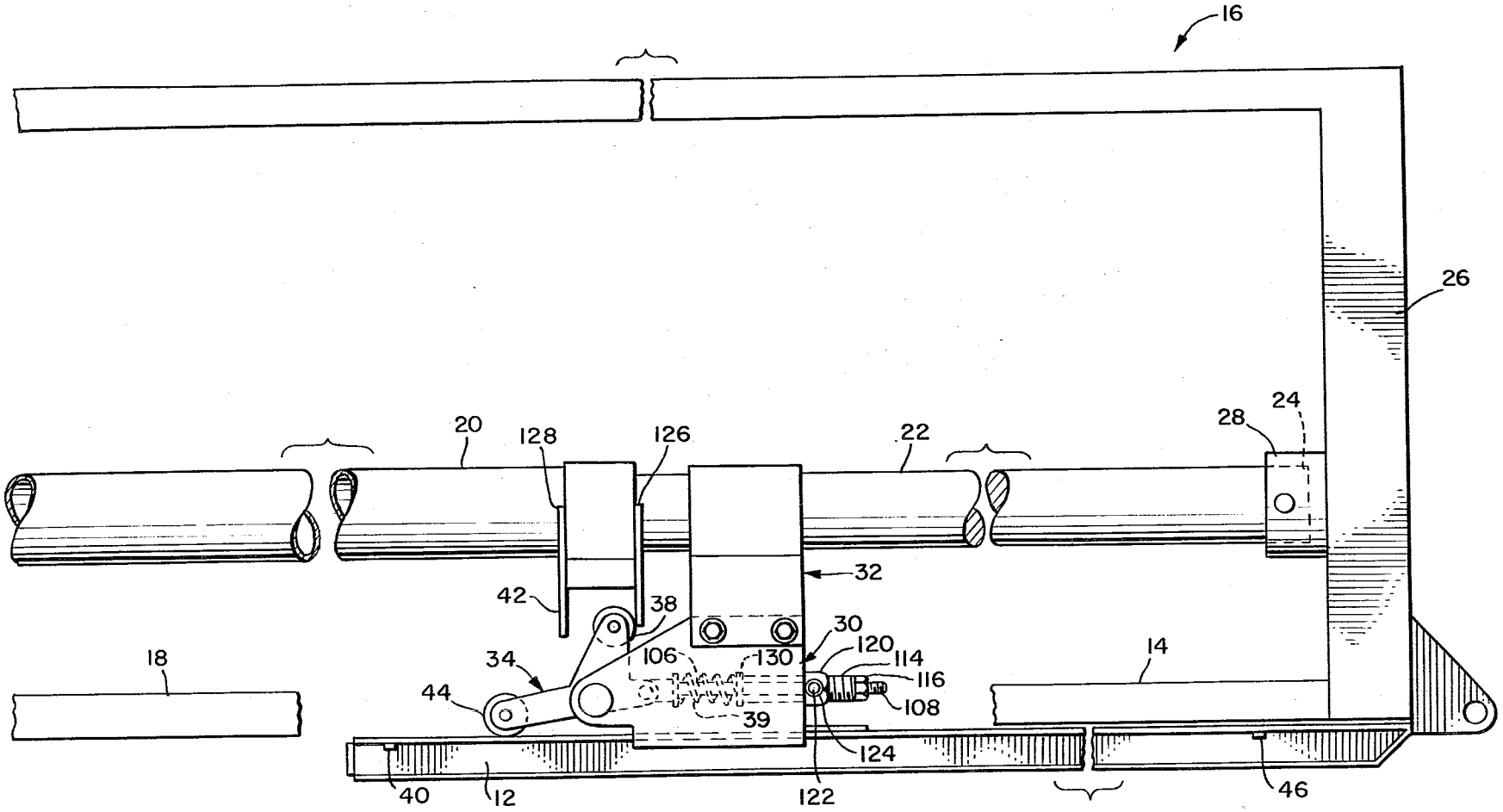
FIG. 1 is a side elevation view of the telescoping cylinder stabilizer in accordance with the present invention, with portions removed for clarity, and showing the stabilizer before deployment.

Turning initially to FIG. 1, there may be seen, generally at 10, a preferred embodiment of a telescoping cylinder stabilizer in accordance with the present invention. Cylinder stabilizer 10 is carried on a suitable support track 12 which is secured in any suitable manner to a lower portion 14 of a telescoping mast or boom generally at 16. Telescoping mast or boom 16 also includes an upper telescoping portion 18, only a portion of which is shown in FIG. 1. The telescoping extension and contraction of mast 16 is accomplished in a known manner by use of hydraulic means such as a hydraulic cylinder 20 and rod 22. Cylinder rod 22 is attached at a first end 24 to a base portion 26 of lower mast portion 14. This connection is accomplished by the insertion of rod end 24 into a socket 28 on base 26. It will be understood that any suitable connection between rod end 24 and base 26 would be appropriate. Cylinder stabilizer 10, as may be seen in FIG. 1, stabilizes cylinder rod 22 which telescopes within cylinder 20. As was discussed previously, this cylinder stabilizer assembly 10 is used primarily in situations in which both cylinder 20 and cylinder rod 22 are quite long in comparison to their diameters; i.e. in cylinders having a high slenderness ratio.

Telescoping cylinder stabilizer 10, as may again be seen in FIG. 1, is comprised generally of a support body 30, a cylinder rod encircling clamp or ring 32 and a spring biased bell crank 34. While each of these assemblies will be discussed in greater detail hereinafter, the following operative description will aid in the understanding of the cylinder stabilizer 10. As cylinder rod 22 is forced out of cylinder 20 by the application of fluid pressure thus causing the extension of upper mast segment 18, a first actuator arm 36 secured to cylinder 20 at the end of cylinder 20 from which rod 22 extends, contacts a first roller 38 on bell crank 34 to slide the cylinder stabilizer support body 30 along support track 12. The rod encircling clamp 32 does not restrict passage of rod 22 therethrough and does not bind or restrict the movement of support body 30 along track 12.

As the cylinder 20 and rod 22 reach their full extension, the support body 30 is halted by engagement with a suitable lug 40 secured to track 12 adjacent its free end. This engagement with lug 40 halts the forward motion of support body 30 and hence of cylinder stabilizer 10. As forward motion of stabilizer 10 is halted, the first actuator arm 36 continues to push against first roller 38 on bell crank 34 until the spring bias of spring 39 joined to the bell crank 34 is overcome and the bell crank 34 assumes its deployed position which may be seen by referring to FIG. 2. As may be seen in FIG. 2, in which corresponding elements are similarly numbered, the end of track 12 and the location of lug 40 are selected so that cylinder 20 can continue in its extension a sufficient amount to let first actuator arm 36 clear the first roller 38 on bell crank 34.

Figure 2:
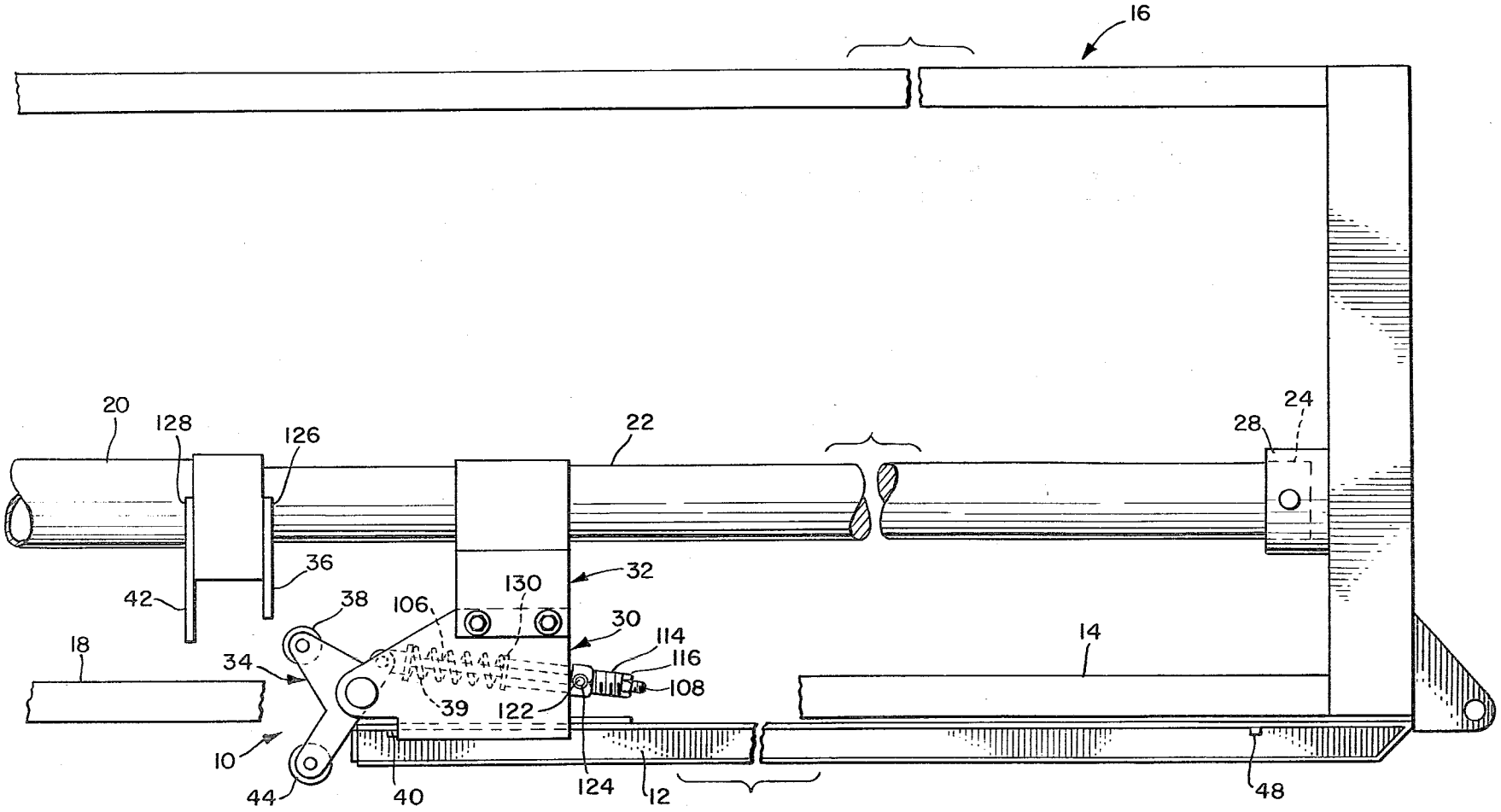
FIG. 2 is a side elevation view similar to FIG. 1 and showing the stabilizer in its operative position.

In the position shown in FIG. 2, stabilizer 10 is deployed and acts to stabilize the elongated cylinder 20 and rod 22 at a point generally equidistant the ends of the cylinder and rod. Since cylinder 20 and rod 22 have a high slenderness ratio, i.e. are quite long in comparison to their diameters, the stabilization afforded by cylinder stabilizer 10 effectively strengthens the cylinder and rod and prevents the flexation and resultant strain which have, in the past, resulted in premature wear and fatigue of the cylinder and rod. As the cylinder 20 and rod 22 are caused to retract thereby lowering or telescoping in the upper mast 18, a second actuator arm 42 contacts the first roller 38 on bell crank 34 and forces the bell crank 34 back against the spring bias afforded by spring 39 to return the bell crank 34 to the orientation shown in FIG. 1. Second actuator arm 42 is also secured to cylinder 20, is spaced a short distance from first arm 36 and, as may be seen in FIGS. 1 and 2, is longer than first arm 36. A second roller 44 carried by bell crank 34 rides on track 12 and facilitates movement of support body 30 along track 12 as cylinder 20 and rod 22 telescope inwardly.

A second lug 46 is secured on track 12 adjacent the base 26 of the lower mast section 14 to limit the movement of support body 30. It will, of course, be understood that the location of the second lug 46 must be selected to correlate with the length of support body 30 and the spacing of first and second arms 36 and 42, respectively so that second lug 46 will not be sheared off or second arm 42 broken. It will also be understood that FIG. 1 shows the cylinder stabilizer 10 being moved to the left by extension of cylinder 20 and rod 22 and that during contraction the second arm 42 would be in contact with roller 38 to move the support body to the right, as seen in FIGS. 1 and 2.

Figure 3:
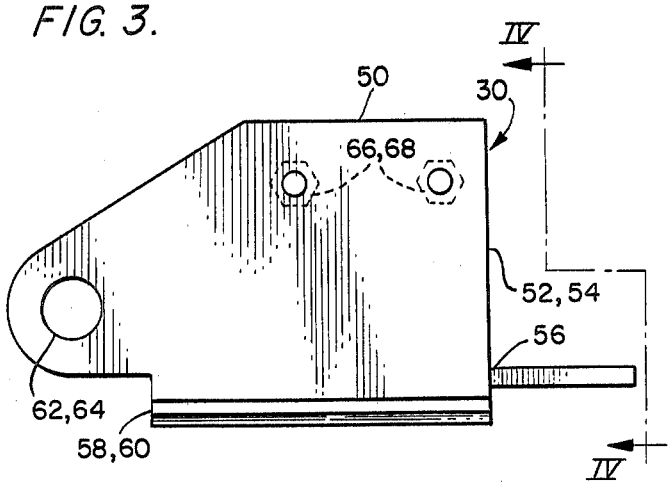
FIG. 3 is a side elevation view of the support body of the cylinder stabilizer of the present invention.
Figure 4:
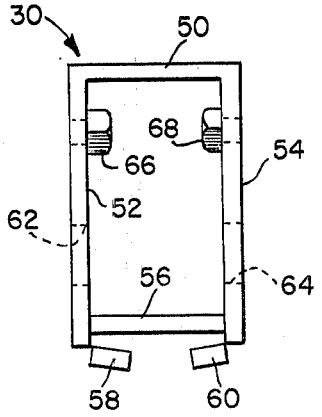
FIG. 4 is an end view of the support body taken along line IV—IV of FIG. 3.

Turning now to FIGS. 3 and 4, support body 30 can be seen more clearly. Support body 30 is a box-shaped channel element having a top 50, side walls 52 and 54 and a bottom 56. As may be seen in FIG. 3, bottom wall 56 extends beyond the side walls and top at a first end of body 30 to form a tail which adds support and prevents binding of body 30 as it slides along track 12. Side walls 52 and 54 extend downwardly below bottom 56 and terminate in spaced inwardly deformable tabs 58 and 60. In use, the support track 12 is received in the space defined by bottom 56 and tabs 58 and 60. These tabs also contact lugs 40 and 46 to limit the motion of the support body 30 along track 12. Side walls 52 and 54 are provided at the second end of body 30 with apertures 62 and 64 through which a pivot pin (not shown) can pass to secure bell crank 34 to support body 30. Similarly, side walls 52 and 54 are also provided with threaded nuts 66 and 68 that are used to secure rod clamp or ring 32 to support body 30.

Figure 5:
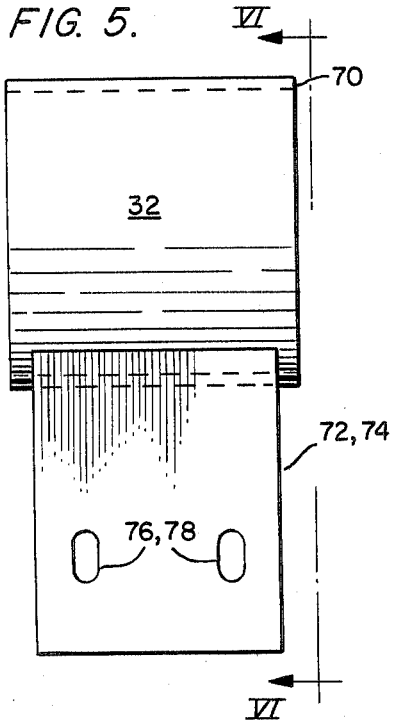
FIG. 5 is a side elevation view of the rod encircling clamp of the cylinder stabilizer of the present invention.
Figure 6:
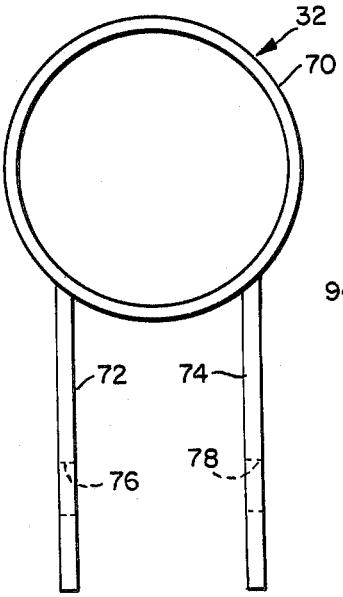
FIG. 6 is an end view of the rod encircling clamp taken along line VI—VI of FIG. 5.

Rod encircling clamp or ring 32 is shown more clearly in FIGS. 5 and 6 and is comprised of a cylindrical sleeve 70 having a pair of spaced, downwardly extending legs 72 and 74. Each of these legs has spaced ovoid mounting holes 76, 78 which are positioned to correspond to the location of the threaded nuts 66 and 68 on support body 30. It will be understood that the rod encircling clamp 32 will be secured to body 30 by passage of bolts (not shown) through holes 76 and 78 into engagement with the nuts 66 and 68. This securement must be done after support body is positioned on track 12 and the sleeve 70 has been placed on the cylinder rod 22. The ovoid shape of the holes 76 and 78 allow for adjustment of the rod encircling clamp 32 with respect to body 30 to prevent binding of the rod 22 as it passes through sleeve 70. While not shown, it will be understood that cylinder sleeve, which is made of steel or the like, may be provided with a suitable liner of a material which will not harm the surface of the cylinder rod 22 as it passes through the sleeve 70.

Figure 7:
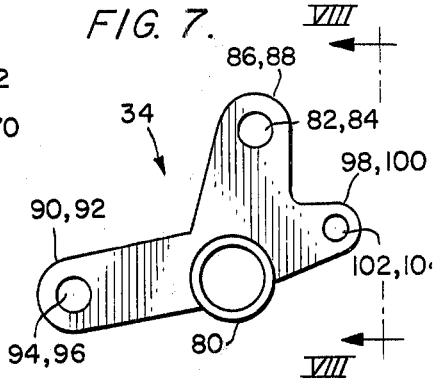
FIG. 7 is a side elevation view of the bell crank of the cylinder stabilizer of the present invention.
Figure 8:
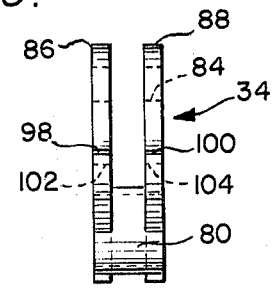
FIG. 8 is an end view of the bell crank taken along line VIII—VIII of FIG. 7.

Referring now to FIGS. 7 and 8, there is shown the bell crank 34. As may be seen in FIG. 7, bell crank 34 has a somewhat inverted T-shape with a hub 80 located at the intersection of the arms and leg of the T. The bell crank 34 is secured to the forward end of support body 30 by passage of a suitable pivot pin (not shown) through the apertures 62 and 64 in the support 30 and through the hub 80 on the bell crank. The first roller 38, which is shown on the bell crank in FIGS. 1 and 2, is secured in place by passage of a suitable pin (not shown) through apertures 82, and 84 at the ends of the leg portions 86 and 88 respectively of the bell crank. The second roller 44, as seen in FIGS. 1 and 2, is similarly secured between the spaced first arm portions 90 and 92 by passage of a suitable pin (not shown) through apertures 94 and 96. The second arms 98 and 100 of the inverted T-shaped bell crank 34 are also formed with apertures 102 and 104, respectively.

Figure 9:
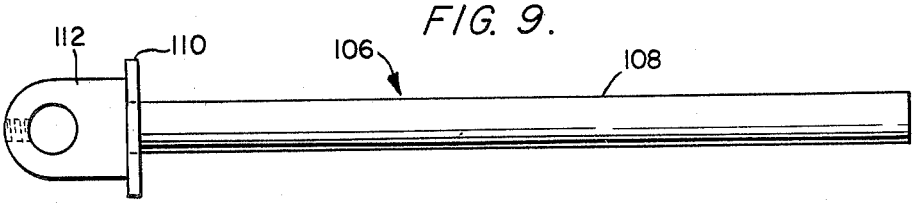
FIG. 9 is a side view of a spring arm for the cylinder stabilizer of the present invention.

Apertures 102 and 104 receive a pivot pin (not shown) to secure a spring arm 106 which may be seen in FIGS. 1 and 2 and more clearly in FIG. 9. As is shown in FIG. 9, spring arm 106 has an elongated shaft 108 which terminates at a first end in a retainer flange 110 beyond which is carried an apertured head 112. Head 112 is secured between the second arms 98 and 100 of bell crank 34 and, as seen in FIGS. 1 and 2, spring 39 is slid over shaft 108.

Figure 10:
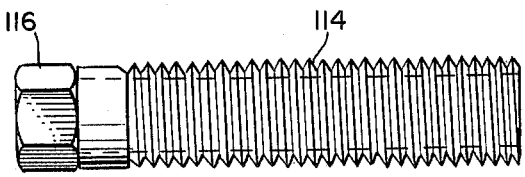
FIG. 10 is a side view of a spring tension adjusting sleeve of the cylinder stabilizer in accordance with the present invention.

Spring tension is adjusted by means of an adjusting sleeve 114 which is shown in FIG. 10 and, in use, in FIGS. 1 and 2. Adjusting sleeve 114 is externally threaded and carries a nut 116 at one end to facilitate rotation of the sleeve 114. As may be seen in FIGS. 1 and 2, sleeve 114 is positioned within a pivot nut 120 which is pivotably secured to support body 30 by, for example, the passage of pivot shafts 112 secured to pivot nut 120 through pivot hubs 124 affixed to support body 30. A washer 130 may be placed between the inner end of adjusting sleeve 114 and spring 39. To adjust spring 39 and hence the force required to move bell crank 34 between the positions shown in FIGS. 1 and 2, adjusting sleeve 114 may be rotated in pivot nut 120 to move the sleeve 114 in or out to increase or decrease spring pressure. The elongated shaft 108 of spring arm 106 extends through the hollow adjusting sleeve 114 and is sufficiently long that it will always extend out the free end of the adjusting sleeve 114 beyond nut 116.

The telescoping cylinder stabilizer 10 in accordance with the present invention can be easily and quickly assembled either on the job site or during manufacture of the telescoping mast or boom with which it is to be used. The bell crank 34 and spring arm 106 are assembled and secured to support body 30. The tension on spring 39 is then adjusted by properly positioning adjusting sleeve 114. The cylinder rod encircling clamp 32 is placed on rod 22 with the cylindrical sleeve 70 being slid along rod 22 until the rod clamp 32 ccan be attached to support body 30. The first and second actuator arms 36 and 42 are secured to cylinder 20 and are properly located and spaced to engage roller 38 in the manner previously discussed. Actuator arms 36 and 42 may be secured to cylinder 20 by any suitable method. For example, hemi annular brackets 126 and 128 which carry first and second actuator arms 36 and 42 respectively, can be bolted or otherwise attached to cylinder 20.

It will be understood that the bulk of the components used to make cylinder stabilizer 10 are steel. The support body 30, bell crank 34, and support track 12 are all steel. The rollers 38 and 44 and the various pivot pins (not shown) can be made of high strength steel. The rod encircling clamp 32 is primarily steel with, as was previously discussed, a liner of a suitable material being placed inside the cylindrical sleeve 70. It will be understood that the specific materials used in the structure of telescoping cylinder stabilizer 10 are not important so long as they have sufficient strength to properly perform their functions.

While there has hereinabove been fully and completely described a preferred embodiment of a telescoping cylinder stabilizer in accordance with the present invention, it will be obvious to one of skill in the art that a number of changes in, for example the materials used, the distance between the stabilizer and the cylinder rod, the length of the cylinder rod and the like can be made without departing from the true spirit and scope of the invention and that the invention is to be limited only by the following claims.

I claim:

1. A telescoping cylinder stabilizer for stabilizing a cylinder and rod which telescopingly extend and contract a mast assembly, said cylinder stabilizer comprising:

a support body moveably carried on a lower mast portion of the mast assembly;

a rod encircling clamp carried by said support body and engaging said rod;

means to move said support body along said lower mast portion during extension and contraction of said cylinder and rod; and means for securing said stabilizer in place to stabilize said rod when said rod and cylinder are extended.

2. The telescoping cylinder stabilizer of claim 1 wherein said support body is slidably carried on a support track attached to said lower mast portion.

3. The telescoping cylinder stabilizer of claim 2 wherein said support track carries lugs, said lugs limiting the motion of said support body.

4. The telescoping cylinder stabilizer of claim 2 wherein said support body includes a top, spaced side walls, and a bottom wall.

5. The stabilizer of claim 4 wherein said side walls include lower inwardly deformable tabs, said tabs engaging said support track.

6. The stabilizer of claim 1 wherein said rod encircling clamp includes a cylindrical sleeve and spaced downwardly extending legs.

7. The stabilizer of claim 6 wherein said cylindrical sleeve encircles said rod.

8. The stabilizer of claim 6 wherein said downwardly extending legs are adjustably secured to side walls of said support body.

9. The telescoping cylinder stabilizer of claim 1 wherein said means to move said support body are first and second spaced actuator arms secured to said cylinder.

10. The stabilizer of claim 9 wherein said actuator arms are of differing lengths.

11. The stabilizer of claim 10 wherein said first actuator arm moves said support body during extension of said cylinder and rod and wherein said second actuator arm moves said support body during contraction of said cylinder and rod.

12. The stabilizer of claim 9 wherein said actuator arms contact a first roller carried on a bell crank which is pivotably secured to said support body.

13. The stabilizer of claim 12 wherein said bell crank further includes a second roller, said second roller engaging a support track secured to said lower mast portion of the mast assembly.

14. The stabilizer of claim 13 wherein said means for securing said stabilizer in place is said bell crank.

15. The stabilizer of claim 14 wherein, said bell crank is moveable into and out of a securement position.

16. The stabilizer of claim 15 wherein said bell crank is spring biased to retain it in or out of said securement position.

17. The stabilizer of claim 16 wherein said bell crank is spring biased by a spring carried on a spring arm, said spring arm being pivotably secured to said bell crank.

18. The stabilizer of claim 17 further including means to adjust the spring force exerted by said spring.

19. The stabilizer of claim 18 wherein said adjusting mean for said spring is an adjusting sleeve which encircles said spring arm, said adjusting sleeve being adjustably secured to said support body.

20. The stabilizer of claim 19 wherein said adjusting sleeve is secured to said support body by a pivotable nut, said adjusting sleeve being threadedly received in said pivotable nut.

* * * * *